United States Patent [19]

Garcia, Jr.

[11] Patent Number: 4,815,905

[45] Date of Patent: Mar. 28, 1989

[54] LOAD STABILIZER FOR CARGO CARRYING VEHICLE

[76] Inventor: Jose Garcia, Jr., 4024 E. Acacia, Fresno, Calif. 93726

[21] Appl. No.: 41,186

[22] Filed: Apr. 22, 1987

[51] Int. Cl.[4] ..... B60D 7/14; B61D 45/00

[52] U.S. Cl. ..... 410/128; 410/34

[58] Field of Search ..... 410/31, 32, 34, 38, 410/121, 127, 128; 105/378

[56] References Cited

U.S. PATENT DOCUMENTS

| | | | |
|---|---|---|---|
| 4,052,083 | 10/1977 | Lutz | 280/179 R |
| 4,082,044 | 4/1978 | Day | 105/376 |
| 4,348,963 | 9/1982 | Dancy | 105/363 |

*Primary Examiner*—Carlton R. Croyle
*Assistant Examiner*—Leonard P. Walnoha
*Attorney, Agent, or Firm*—Townsend and Townsend

[57] ABSTRACT

A cargo vehicle having a load stabilizing system on its cargo-carrying portion, and the vehicle has spaced inner and outer walls at each of its sides. The stabilizing system is provided at each side, respectively, of the vehicle and can move into and out of engagement with the cargo yet the mounting means for the stabilizing system is recessed into the hollow space between the inner and outer side walls of the vehicle. The stabilizing system includes a side panel or a pair of vertically spaced, parallel side panels for each side of the vehicle respectively. The mounting means for the side panels comprises support arms which are pivotally mounted on the ribs between the inner and outer walls. The mounting means includes sleeves welded to brackets affixed to the ribs. The sleeves are concealed between the vehicle side walls and the arms extend through slots in the inner side wall. The shaft of one of the pivot arms of each of the panels extends downwardly to a location below the floor of the vehicle and coupled with the shaft to cause rotation of the shaft to an angle of 90° to thereby shift the corresponding panel from a retracted position to an expanded position and return. The power device has a lock thereon for locking the panels against the load regardless of how far the panels have projected inwardly from the adjacent inner side wall of the vehicle.

5 Claims, 6 Drawing Sheets

FIG. 2
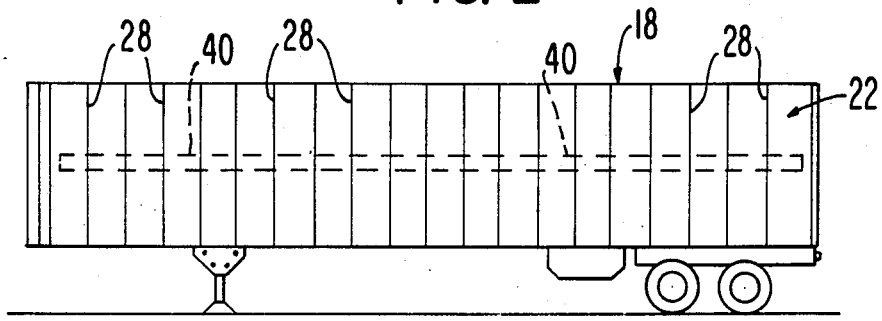
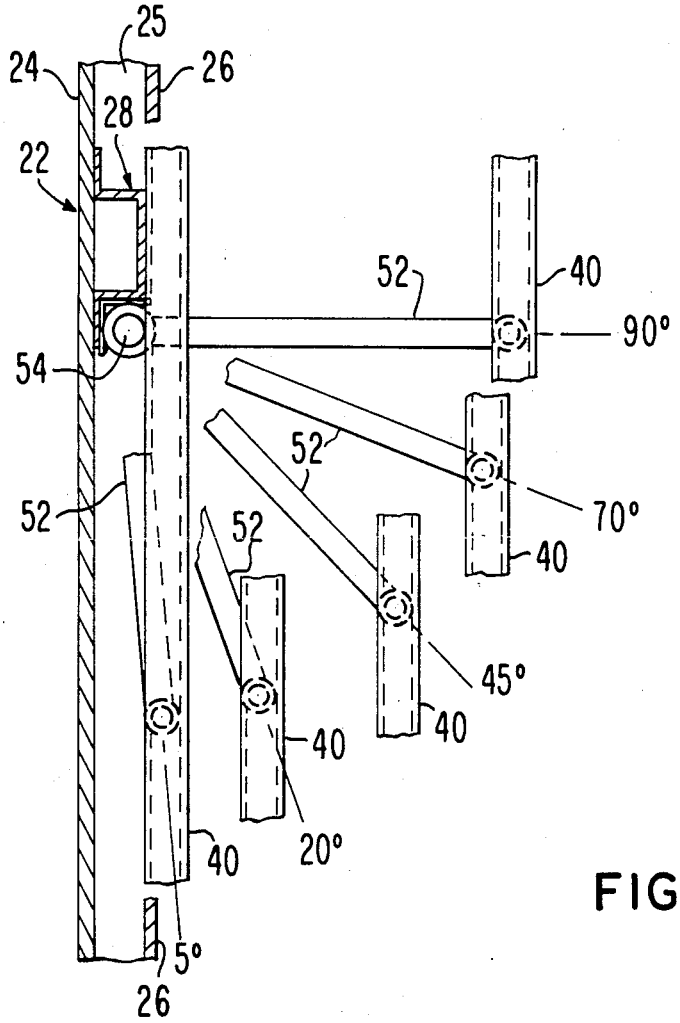
FIG. 3

LOAD STABILIZER FOR CARGO CARRYING VEHICLE

This invention relates to improvements in the stabilizing of cargo, such as cartons loaded in a trailer or on a truck having a pair of spaced sides and, more particularly, to a stabilizer carried by a vehicle on the sides thereof for movement into gripping relationship with the cargo in the vehicle.

BACKGROUND OF THE INVENTION

In hauling cargo comprised of cartons of constant width, such as milk cartons, beer cartons, soft drink cartons and the like, the cartons are typically located in the center of trailer or on the bed of a truck having sides. The cartons are usually placed on a pallet and then driven by a fork lift into the bed of the truck or the trailer. To allow for maneuverability of the fork lift itself, spaces are left at between the cartons and the sides of the truck or trailer. During travel over the road, the cartons will shift laterally back and forth unless there is some stabilizing means which braces the cartons and prevents such shifting movements.

Stabilizers moveable into engagement with cartons on a vehicle have been known and used in the past. For instance, U.S. Pat. No. 4,052,083 shows a load bracing device which is suspended from the roof of a vehicle and includes a frame having laterally movable load engaging members attached thereto. A single actuating means is located at one end of the device for expanding and contracting the device into and out of engagement with a load to be braced. Alternate embodiments include load engaging members on the interior sides of the walls of the vehicle. The structure of this disclosure is not satisfactory because the stabilizer is exposed at all times, thereby minimizing the useful cargo space in the vehicle.

Other attempts in the prior art have been made to mount stabilizing panels on the inner surface of the side walls of a vehicle which carries a cargo comprised of constant width cartons or modules. These stabilizing panels, when retracted extend along the side walls of the vehicle and project outwardly a considerable distance from the side walls because the mounting means for the panels is exposed to thereby minimize the space widthwise of the vehicle for receiving loads. Moreover, the ends of the panels are blunt and squared off so that the ends sometimes damage the cartons of the cargo which is being loaded into or taken off the vehicle.

Because of these drawbacks, a need exists for an improved stabilizer for a vehicle for carrying cartons typically of constant width dimension, especially for vehicles having an inner wall and an outer wall spaced outwardly from the inner wall. The present invention satisfies this need.

SUMMARY OF THE INVENTION

The present invention is directed to an improved vehicle having load stabilizing means on the cargo carrying portion of the vehicle having spaced inner and outer side walls. The stabilizing means is provided at each side, respectively, of the vehicle and can move into and out of engagement with the cargo yet the mounting means for the stabilizing means is recessed into the hollow space between the inner and outer walls of the vehicle. This feature maximizes the space available for the load as well as to conceal the mounting means and provide a more finished appearance for the stabilizing system itself.

The stabilizing means includes a side panel or a pair of vertically spaced, parallel side panels for each side of the vehicle respectively. The mounting means for the side panels of each side of the vehicle comprises support arms which are pivotally mounted on the ribs or channel members between the inner and outer walls defining each side, respectively. The mounting means includes sleeves which are welded to brackets affixed by bolts or the like to the ribs between the inner and outer walls of each side of the vehicle. The sleeves are concealed between the vehicle side walls and the arms extend through slots in the inner side wall; thus, the only visible part of the stabilizer when the stabilizer is retracted is the panel or panels so that the mounting means is concealed exteriorly of the inner side wall of the vehicle.

The drive shaft of one of the pivot arms of each of the panels extends downwardly to a location below the floor of the vehicle, and a power source is located below the vehicle and coupled with the shaft to cause rotation of the shaft at least to an angle of 90° to thereby shift the corresponding panel from a retracted position to an expanded position and return. The direction of rotation of the drive shaft is such that each panel is moved from a retracted position inwardly and toward the forward bulkhead of the vehicle. The power source has lock means thereon for locking the panels against the load regardless of how far the panels have projected inwardly from the adjacent inner side wall of the vehicle.

The ends of the panels are provided with beveled surfaces to prevent damage to the load in the event that the load strikes the panels as the load is placed onto or taken off the vehicle.

The primary object of the present invention is to provide an improved stabilizer for a load-carrying vehicle having a pair of spaced inner and outer wall for each of the sides wherein the load placed between the sides of the vehicle is prevented from shifting movements by a pair of stabilizers when the latter are in an operative positions at the sides of the load yet the mounting means of the stabilizers is recessed between the inner and outer walls at the sides of the vehicle to maximize the space available for the load as well as to provide a finished appearance for the stabilizer system.

Another objects of the present invention is to provide a load carrying vehicle having a pair of spaced sides with each side having inner and outer walls spaced from each other wherein a stabilizer mounted on each side, respectively, of the vehicle has its mounting means recessed in the space between the inner and outer walls of each side and the drive means for each panel is beneath the bed of the vehicle and to thereby maximize the load carrying capability of the vehicle and to prevent the load from contacting the mounting means as the load is placed on and taken off the vehicle to avoid damage to the mounting means and eliminate the need for frequent maintenance.

Other objects of the present invention will become apparent as the following specification progresses, where first being had to the accompanying drawings for an illustration of the invention.

IN THE DRAWINGS

FIG. 2 is a side elevational view of a typical trailer with which the stabilizer system of the present invention is used;

FIG. 3 is a fragmentary cross-sectional view looking downwardly on the stabilizer system of the present invention as it is attached to a rib between inner and outer walls at a side of the vehicle of FIGS. 1 and 2;

Figure 1:
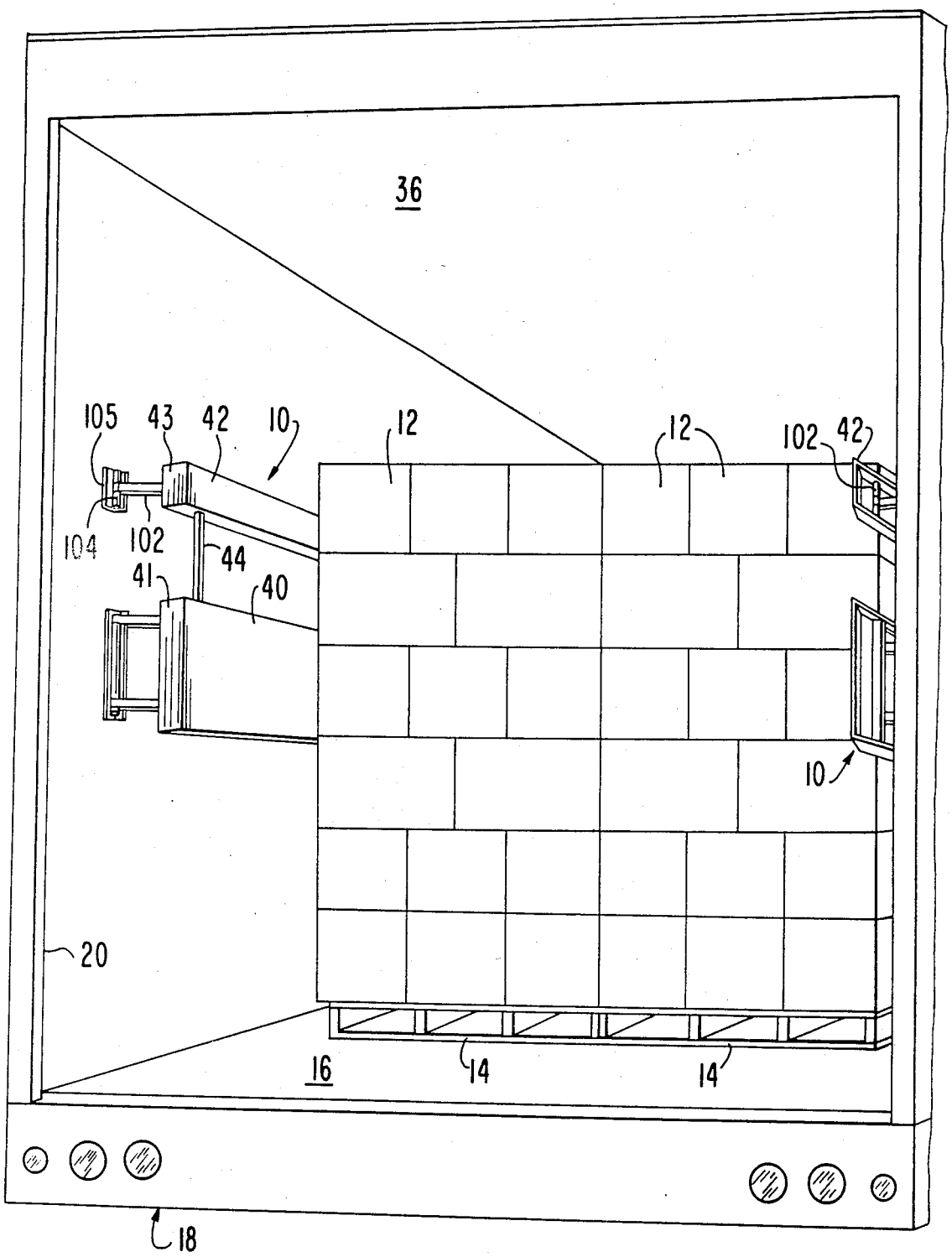
FIG. 1 is a fragmentary, perspective view of a vehicle, such as a trailer showing the open rear end thereof and cartons stacked in place with the cartons being stabilized with the stabilizer system of the present invention.

The stabilizer system of the present invention is broadly denoted by the numeral 10 and is shown in a preferred embodiment in use in FIG. 1. The stabilizer system 10 is adapted for stabilizing cartons 12 which are stacked on pallets 14 and placed on the floor 16 or bed of a vehicle 18 having a rear open end 20 for receiving the cartons on the pallets. Typically, the pallets are driven into the rear open end 20 of vehicle 18, and the pallets with the cartons thereon are deposited in the vehicle on the floor 16 while leaving spaces on the sides of the cartons. It is in the upper part of these side spaces that stabilizer system 10 is located so that the stabilizer system, when actuated, will bear against the sides of the cartons near the upper part of the stack of cartons and hold the cartons against lateral movements which otherwise disrupt the stacking arrangement and cause the cartons possibly to tumble down from the stack and cause damage to the contents of the cartons.

Vehicle 18 can be of any suitable type. For instance, it can be a truck, a trailer of the type shown in FIG. 2, or any type of conveyance which has a pair of opposed, generally parallel, upright sides. For purposes of illustration the vehicle will be considered to be a trailer as shown in FIG. 2 with the trailer having a pair of opposed sides 22. Each side 22 will be comprised of an outer wall 24 and an inner wall 26 spaced inwardly from outer wall 24 as shown in FIGS. 1, 3, 4 and 6. The outer and inner walls 24 and 26 are kept spaced apart by a plurality of brackets or ribs 28 of the type shown in FIG. 6 and the ribs are vertical and parallel with each other as shown in FIG. 2.

For purposes of illustration, each rib 28 is hat-shaped inasmuch as it has a pair of flanges 30 connected to an outer, flat member 32 by a pair of legs 34. The ribs 28 typically extend from the roof 36 (FIG. 1) of the vehicle 18 to the floor 16 thereof as shown in FIG. 2. Flanges 30 are secured in any suitable manner to the inner surface 38 of outer wall 24. Typically, inner wall 26 has a thickness of about one-quarter inch and is typically formed of plywood. It can be of another thickness as well and can be of any suitable material capable of withstanding hard usage.

Stabilizer system 10 includes at least one panel 40 for each side 22, respectively, of the vehicle 18. Typically for a relatively long vehicle as shown in FIG. 2, there will be two panels 40 for each side 22, respectively. Thus, for a vehicle 18 having a length of approximately 45 feet, each panel 40 will typically be 22.5 feet in length.

Panels 40 each have mounting means which is at least partially recessed in the space 25 between inner and outer walls 24 and 26 of each side 22. Also, each panel 40 will have a smaller width panel 42 coupled therewith by one or more links or rods 44 as shown in FIG. 1. Typically, panel 42 can be one half the height of panel 40 so that if panel 40 is approximately 18 inches in height, panel 42 will be nine inches in height. Panel 42 will also have a mounting means partially recessed in space 25.

Figure 4:
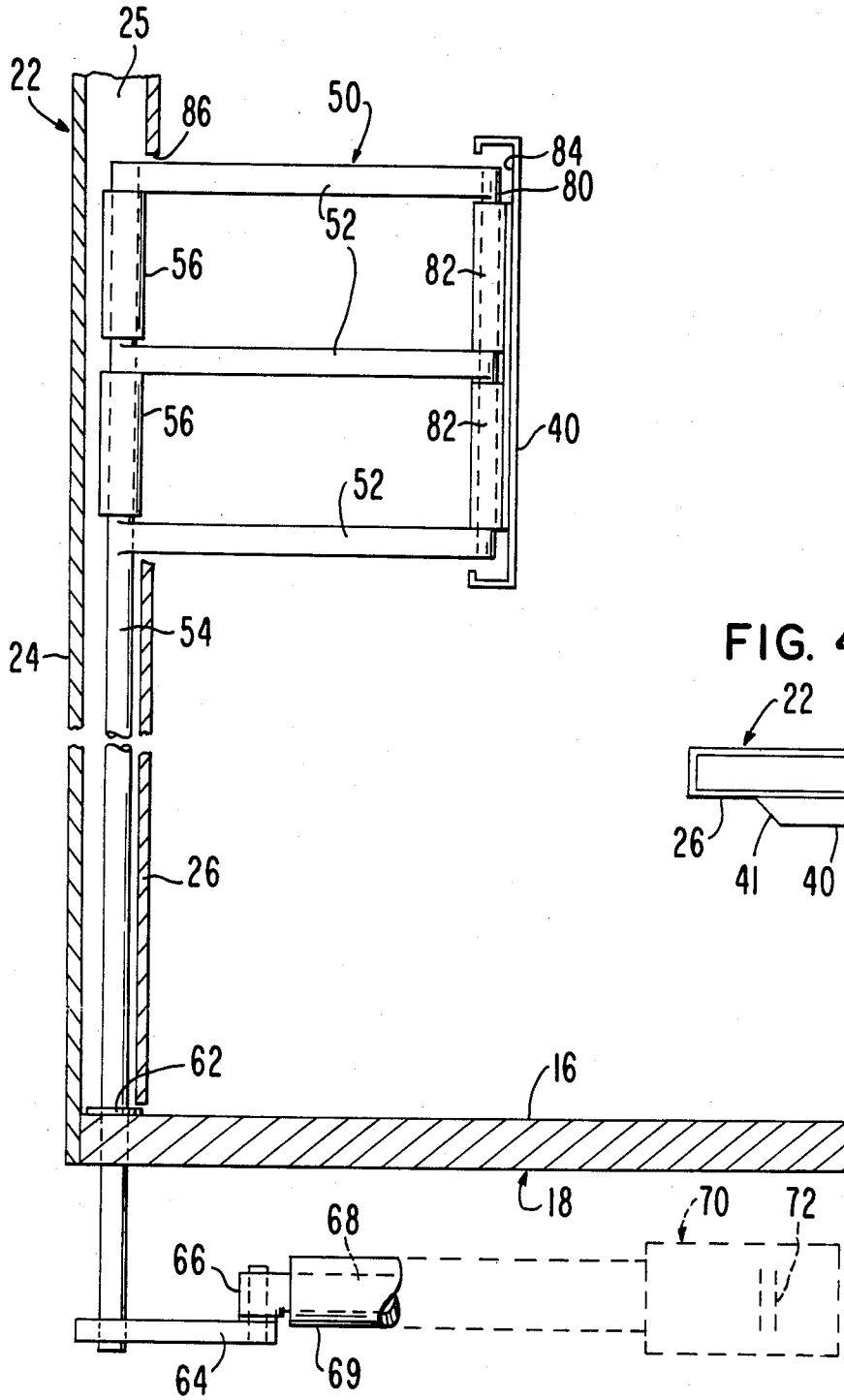
FIG. 4 is a vertical section through one side and the floor of the vehicle, showing the stabilizer system in its extended condition.
Figure 7:
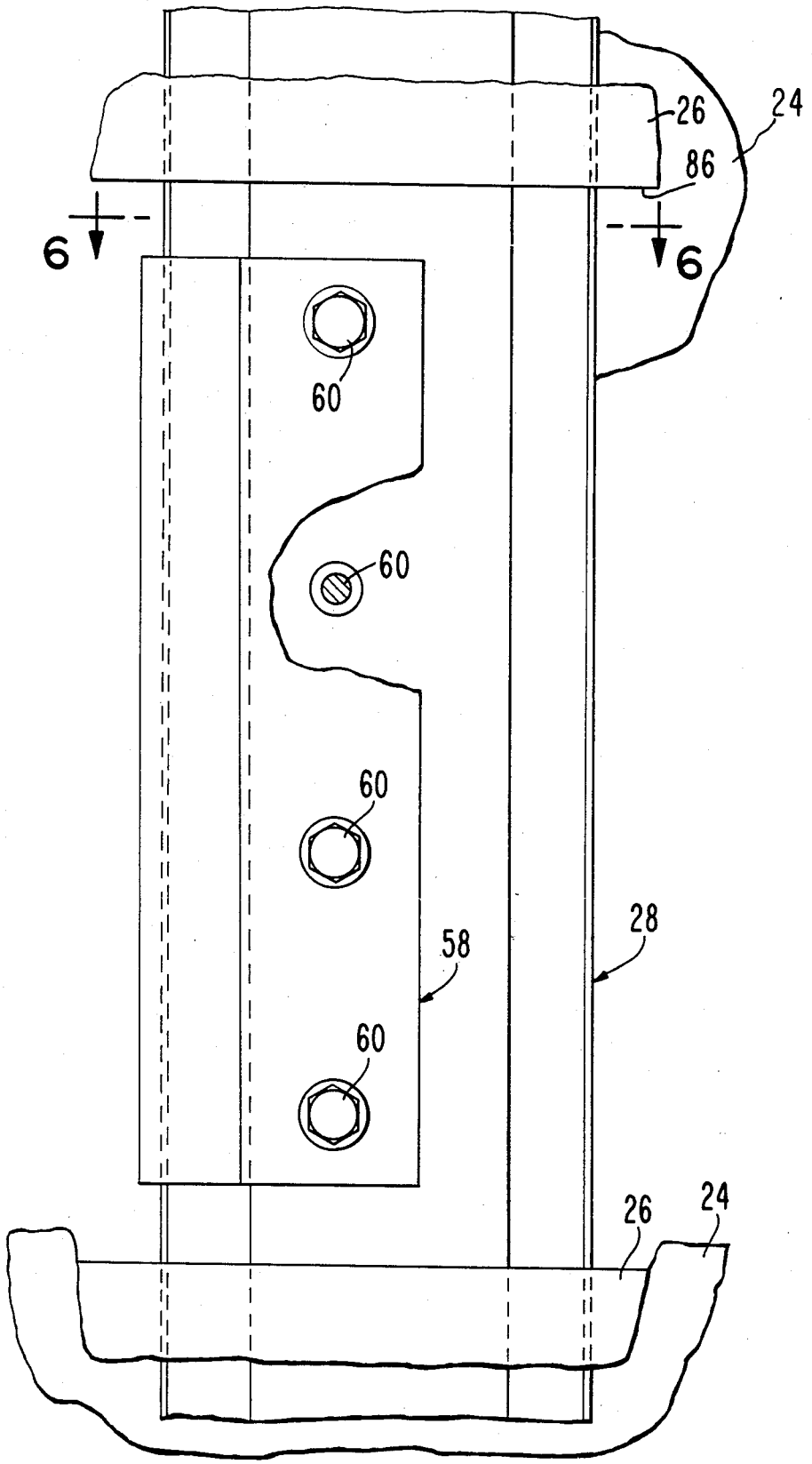
FIG. 7 is a view similar to FIG. 5 but showing a side eleveational view of the rib and the way in which the stabilizer system is coupled to the rib.
Figure 8:
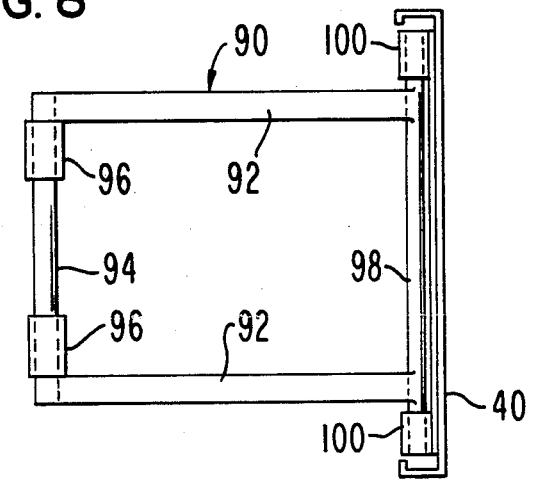
FIG. 8 is an end elevational view of a pivotal support frame forming part of the stabilizer system.
Figure 9:
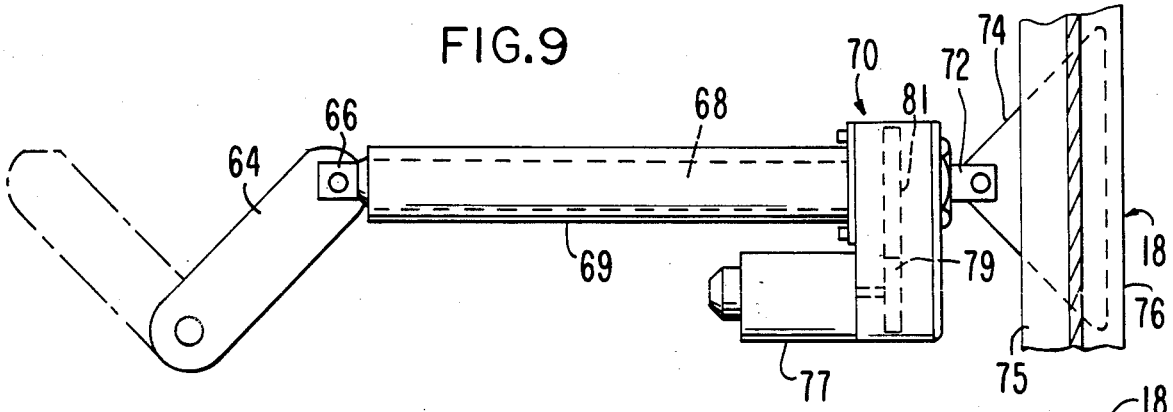
FIG. 9 is a side elevational view of the power means for moving a stabilizer panel of the stabilizer system to move it into and out of its operative position.
Figure 10:
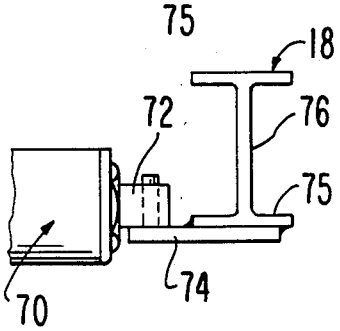
FIG. 10 is a fragmentary end elevational view of the power device of FIG. 9, showing the way in which it is coupled to an I-beam below the floor of the vehicle.

Each panel 40 has pivoted frames as shown in FIGS. 4 and 8 to mount the panel on a side 22 of vehicle 18. For each panel 40, there will be at least one frame 50 of the type shown in FIG. 4, frame 50 including three vertically spaced, horizontal arms 52 which are parallel with each other and which have first ends coupled to a shaft 54 rotatably mounted in a pair of vertically spaced sleeves 56. The sleeves 56 are welded to a Z-shaped bracket 58 (FIGS. 6 and 7) secured by a number of bolts 60 (FIG. 6) to the member 32 of an adjacent rib 28. Shaft 54 is rotatably mounted by sleeves 56 and by a bearing 62 (FIG. 4) mounted on vehicle 18 near the floor 16 thereof. The shaft extends beneath the floor and is pivotally coupled to the outer end of an arm 64 pivotally carried on the outer end 66 of a piston 68 of a power device 70 having lock means 72 for locking piston 68 in any fixed, operative position.

Power device 70 is mounted in any suitable manner on vehicle 10 beneath floor 16 as shown in FIG. 4. For purposes of illustration, power device 70 has an ear 72 secured to a plate 74 which is welded to a flange 75 of an I-beam 76 forming part of vehicle 18.

Any suitable power device 70 can be used. For purposes of illustration, a suitable power device is a linear actuator made and sold by Warner Electric Brade and Clutch Company, South Beloit, Ill. 61080 as model D11-20A5. Such an actuator has a DC or AC electric motor 77 coupled to gear means 79 which, in turn, is coupled to a clutch 81 which, in a sense, forms a lock means for locking piston 68 in any operative position. Motor 77 will be coupled to a control means (not shown) which will supply battery voltage to motor 77 to operate it and cause piston 68 to move into and out of the cylinder 69 associated therewith.

The outer ends of arms 52 (FIG. 4) are coupled to a shaft 80 which is received within sleeves 82 rigid in any suitable manner to the inner surface 84 of the adjacent panel 40. Thus, panel 40 is pivotally mounted by arms 52 on the adjacent wall 22 of vehicle 18.

Panel 40 has a cross-section as shown in FIG. 4. To this end, the panel is transversely C-shaped and the panel is typically made of a suitable material, such as aluminum, to make it light in weight as well as rugged in construction.

Figure 4A:
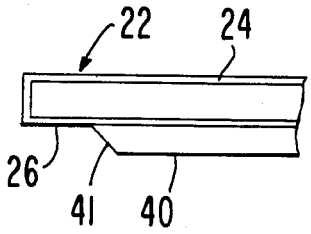
FIG. 4A is a fragmentary cross-sectional view of one side of the vehicle, showing a beveled end surface on a panel of the stabilizer system.
Figure 5:
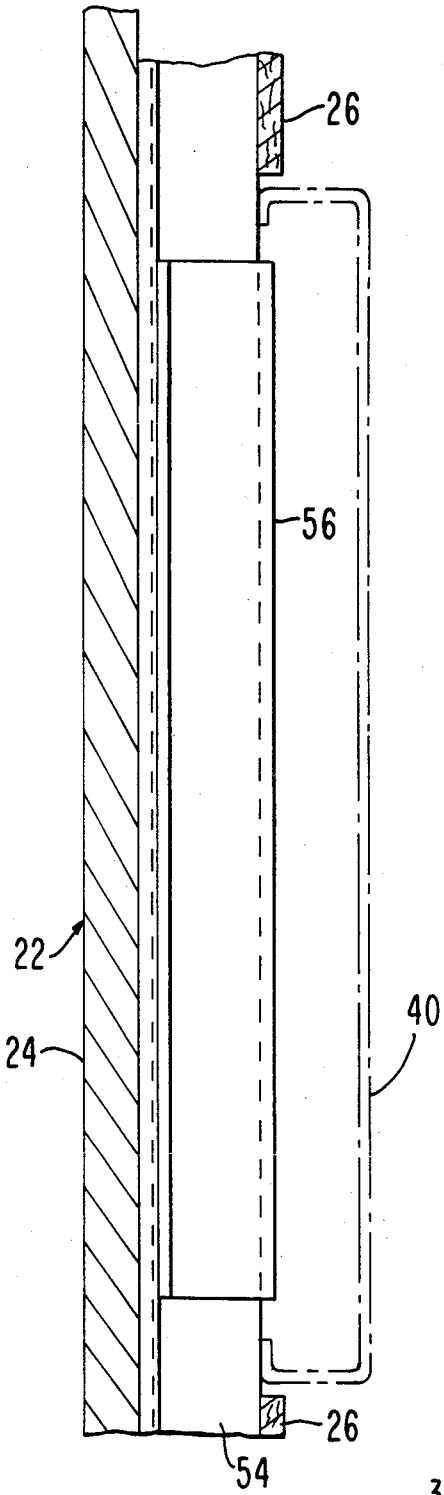
FIG. 5 is an enlarged, fragmentary cross-sectional view of the stabilizer system showing the way in which it is coupled to a rib between the inner and outer walls of the side of the vehicle.
Figure 6:
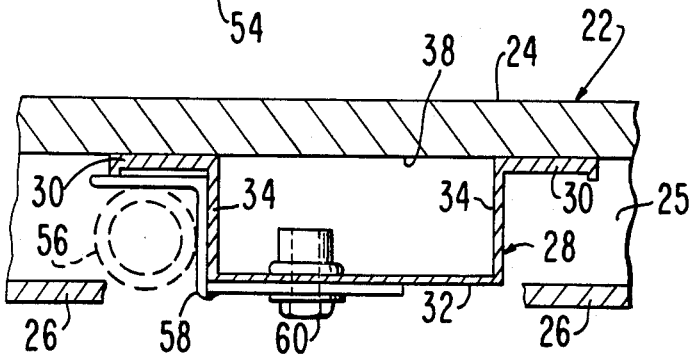
FIG. 6 is a cross-sectional view taken along lines 6—6 of FIG. 7.

The ends of panel 40 have beveled surfaces 41 as shown in FIGS. 1 and 4A. The purpose of the beveled surfaces 41 is to prevent damage to the cartons 12 when the cartons are placed into or taken out of the vehicle. FIG. 4 shows the location of a beveled surface 41 with reference to the rear open end 20 of vehicle 18.

The inner wall 26, as shown in FIG. 4, is cut away to present an elongated, generally horizontal slot or opening 86 to allow arms 52 to project outwardly from shaft 54 as the corresponding panel 40 is moved into an operative position against the adjacent side of the carton stack as shown in FIG. 1. Since inner wall 26 typically is of plywood, the slot or opening 86 can be readily made with a saw. The height of the opening is only necessary to accommodate the height of frame 50 including the three arms 52.

While there is only a single actuating frame 50, there are several additional support frames 90 of the type shown in FIG. 8. Frames 90 do not have a shaft 54 which extends downwardly below the floor 16 of the vehicle 18. Instead, frames 90 only include a pair of horizontal arms 92 which are vertically spaced from each other and are generally parallel. The arms 92 are connected at their inner ends to a short shaft 94 carried by a pair of sleeves 96 which in turn are rigidly secured in the manner shown in FIG. 6 to a Z-shaped bracket 58 which is bolted or otherwise secured to the adjacent rib 28.

The outer ends of arms 92 are connected to a shaft 98 which is rotatably mounted by sleeves 100 on the inner surface of the corresponding panel 40.

Each panel 42 associated with a panel 40 has an arm 102 (FIG. 1) pivotally mounted in any suitable manner to the inner surface of the corresponding panel 42 and also pivotally mounted by sleeve means 104 to the adjacent rib 28 in the manner described above with respect to FIGS. 4, 6 and 8. Sleeve means 104 is recessed in space 25 between walls 24 and 26. A slot or opening 105 (FIG. 1) is cut in wall 26 to allow arm 102 to project toward cartons 12. There is no drive means associated with each panel 42 other than the links 44 which assure that, as each panel 40 is pivoted to its operative position, its corresponding panel 42 will also move into its operative position.

In use, stabilizer system 10 will be mounted on sides 22 of vehicle 18 in such a manner that panels 40 and 42 of each side will be moveable from positions directly adjacent to the inner surface of the corresponding inner wall 26 to operative positions in which the panels 40 and 42 are in positions for engaging the cartons 12 after the cartons have been put into place in the manner shown in FIG. 1. Thus, assuming that the cartons are in place, and it is desired to actuate the stabilizer system, each of the motors 77 for each panel 40, respectively, is energized simultaneously or, if desired, one after another, until the corresponding panels 40 and 42 have been pivoted outwardly so that the outer surfaces of panels 40 and 42 engage the adjacent side of the stack of cartons 12 as shown in FIG. 1.

FIG. 3 shows the various positions of an arm 52 as the arm pivots outwardly from its retracted position to its fully operative position. For purposes of illustration, in the retracted position, the arm 52 is typically at 5° with respect to the plane of the adjacent side 22. FIG. 3 shows the position of panel 40 when the arm 52 is at 20°, 45°, 70° and 90°.

Generally, at 90°, the panels 40 and 42 will engage the side surfaces of the stack of cartons 12. However, if a panel 40 engages a stack of cartons before the arm reaches a 90° angle with reference the plane of the adjacent side 22, the cartons will still be stabilized by the panels inasmuch as the piston 68 of the corresponding power device 70 will have been locked in place by lock 72 of the power device. Thus, even if the cartons are slightly wider than normal, stabilizer system 10 will still be operable to stabilize the cartons and prevent them from toppling over during transit over a roadway. It has been determined that stabilizer 10 is at least operable when arms 52 are in the range of 45°-90° (FIG. 3).

At the end of the trip when the cartons are to be unloaded from vehicle 18, the panels 40 and 42 are moved into their retracted positions (FIG. 3) and the cartons can then be removed from the vehicle.

I claim:

1. A stabilizing system for a load carried on a vehicle having a pair of spaced sides with each side having an outer wall, an inner wall spaced inwardly from the outer wall and having an opening therein, and a plurality of vertical, laterally spaced ribs between and connecting the inner and outer walls, said stabilizing system comprising: a panel for each side, respectively; means pivotally coupled to the panel for mounting the panel on the respective side of the vehicle for movement from a retracted position in which the panel is adjacent to the inner wall to an operative position spaced inwardly from the inner wall and against the load adjacent thereto, said mounting means having means for rigidly coupling the same to one of said ribs, whereby the mounting means can be concealed in the space between the inner and outer walls; and power means adapted to be mounted below the floor of the vehicle and coupled with the mounting means for pivoting the panel into and out of its operative position, said mounting means including at least one support frame, means pivotally mounting the support frame on the panel, the support frame adapted to extend through the opening in the inner wall of the respective side of the vehicle, the support frame having a shaft extending below the bed of the vehicle, said power means including a vertical shaft and a drive mechanism for rotating the shift about its axis sufficiently to move the panel into and out of its operative position.

2. A stabilizing system as set forth in claim 1, wherein said support frame includes a plurality of vertically spaced support arms.

3. A stabilizing system as set forth in claim 2, wherein the mounting means further includes a pair of spaced sleeves, the shaft being rotatable in the sleeves, a pair of said support arms extending laterally from the shaft, there being bracket means for mounting the sleeves on a respective rib, and means for coupling the bracket means to a respective rib.

4. A stabilizing system as set forth in claim 1, wherein the panel has a pair of vertically spaced sections, the lower section being coupled to the support frame, the upper section being provided with a connector coupling it to the upper margin of the lower section.

5. A stabilizing system as set forth in claim 1, wherein the panel has a beveled end surface which prevents damage to the load as the load is moved into or out of the vehicle.

* * * * *